United States Patent [19]

Joyce

[11] 4,034,430

[45] July 12, 1977

[54] WATER-WALKING APPARATUS

[76] Inventor: Albert W. Joyce, Wildwood Commons, Rte. 2, Box 232-31, Wildwood, Fla. 32785

[21] Appl. No.: 636,215

[22] Filed: Nov. 28, 1975

[51] Int. Cl.[2] ..... B63H 16/08; A63C 15/04

[52] U.S. Cl. ..... 9/310 D; 115/22; 115/26

[58] Field of Search ..... 9/310 D, 301; 115/22, 115/26, 25, 31

[56] References Cited

U.S. PATENT DOCUMENTS

| | | | |
|---|---|---|---|
| 3,027,576 | 3/1962 | Fines | 9/310 D |
| 3,084,356 | 4/1963 | Wheat | 9/310 D |
| 3,621,500 | 11/1971 | Senghas | 9/310 D |
| 3,800,734 | 4/1974 | Whang | 9/310 D |
| 3,877,409 | 4/1975 | Krogseng | 9/310 D |

*Primary Examiner*—Trygve M. Blix
*Assistant Examiner*—Gregory W. O'Connor
*Attorney, Agent, or Firm*—Joel Halpern

[57] ABSTRACT

Apparatus for walking on water includes a pair of buoyant pontoons adapted to support a person afloat in water and balancing means for the person. The pontoons are pivotably interconnected by transverse stabilizers consisting essentially of a pair of elongated slotted members. Bolts or studs are provided on the pontoons dimensioned to permit same to slide within the slots of each member. A transversely extending paddle element is mounted at the bottom of the pontoons and is pivotable substantially 90° from a substantially vertical position to a rearward substantially horizontal position.

5 Claims, 4 Drawing Figures

WATER-WALKING APPARATUS

BACKGROUND OF THE INVENTION

The present invention relates to water-walking apparatus and more particularly to apparatus including a stabilized pair of interconnected manually power pontoons.

Water-walking shoes or pontoons have been known for a considerable period of time heretofore. Essentially such apparatus includes a pair of individual buoyant shoes or pontoons and some means for stabilizing the shoes against lateral drift and pitch and for assisting in propulsion. However, past constructions have either failed to successfully cope with the factors of stability and propulston or have required complex arrangements which necessitated increased cost and/or increased difficulties in manufacture. U.S. Pat. No. 3,835494 issued Sept. 17, 1975 to Earle T. Dougherty, for example, requires the provision of an internal tunnel structure adapted to admit and discharge water and flipper structure in addition to manually operable fins. Obviously the more structural features required to obtain the desired performance the less attractive the apparatus becomes because of the increased cost and many acturing problems. Further, with prior water-walking shoes it was extremely difficult for the user to remount the shoes in the water in the event he capcized or otherwise lost the shoes.

SUMMARY OF THE INVENTION

It is one object of the invention to provide water-walking apparatus with stabilizing and propulsion means which can be manufactured and marketed at a relatively low cost.

It is another object of the invention to provide water-walking apparatus with improved lateral drift control features.

Still another object of the invention is the provision of water-waking apparatus in combination with a pole-bucket balancer affording improved balance control.

Yet another object of the invention is the provision of water-walking apparatus which is more easily remounted in water.

Other objects and advantages of the invention will become readily apparent from the following description of the invention.

According to the present invention there is provided apparatus for walking on water comprising in combination:

a pair of elongated buoyant pontoons;

a boot in each of said pontoons for receiving and supporting the foot of a person;

a paddle element mounted at the bottom and extending transversely of the pontoons, the paddle element being pivotable by water pressure between a substantially vertical position and a rearward substantially horizontal position;

transverse stabilizer means including at least one elongated member secured pivotably and slidably to each of the pontoons whereby said pontoons are interconnected so as to be movable longitudinally and laterally relative to each other;

and balancing means for the user of the apparatus.

BRIEF DESCRIPTION OF THE DRAWINGS

In order that the invention may be more fully understood it will now be described, by way of example, with reference to the accompanying drawings in which.

DETAILED DESCRIPTION OF THE INVENTION

Figure 1:
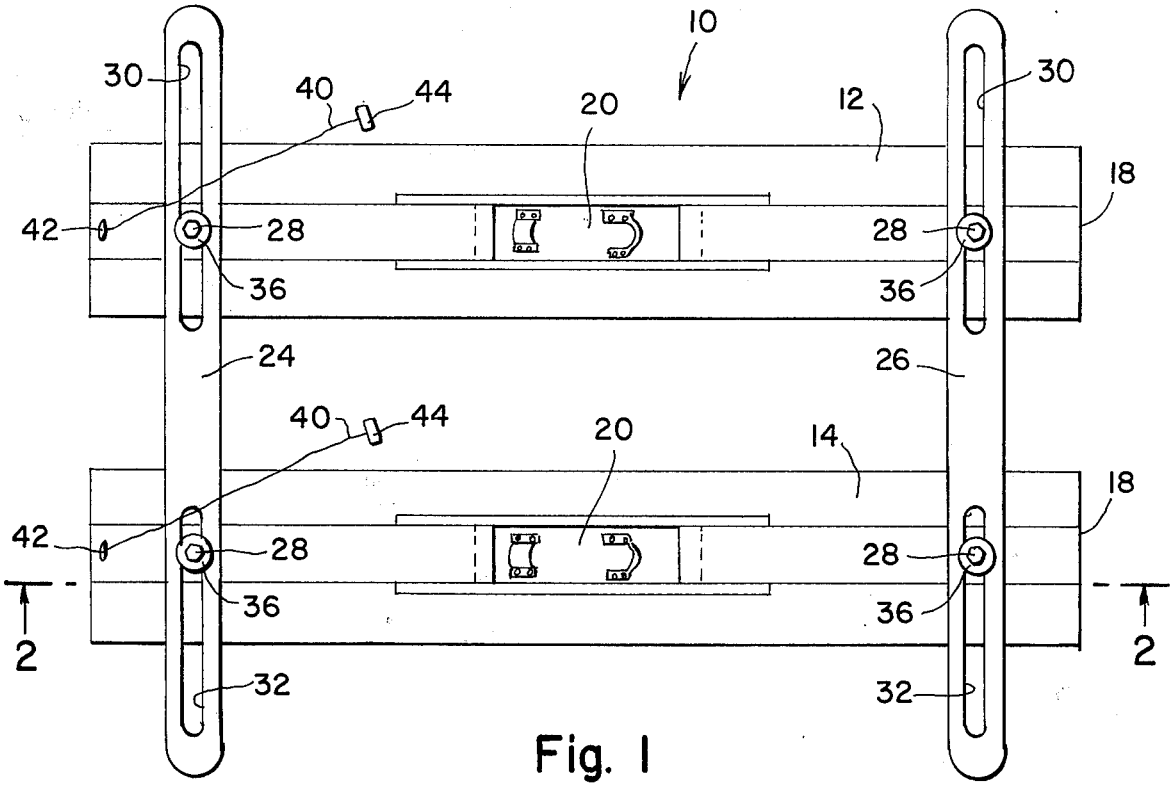
FIG. 1 is a top plan view of water-walking apparatus embodying the features of this invention.

Referring to the drawings there is shown generally by reference numeral 10 water-walking apparatus. The apparatus includes a pair of elongated pontoons 12, 14 the frames of which are preferably made of plywood and given an upturned prow 16 and a squared stern 18. The frame may be formed in part by one of the conventional lightweight buoyant synthetic plastic materials such as expanded polystyrene marketed under the name Styrofoam.

A boot or foot well 20 is provided in the medial region of each pontoon and, as is known, is adapted to receive and support a foot of the user.

Figure 2:
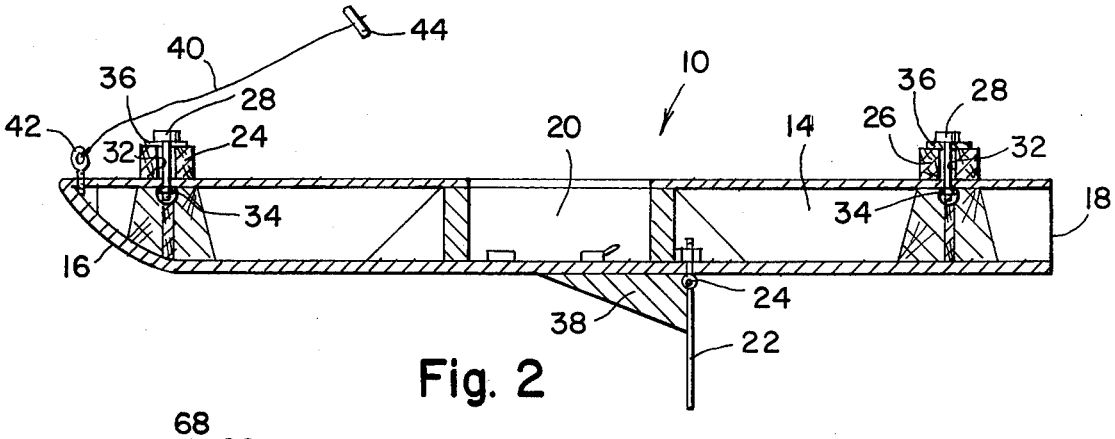
FIG. 2 is a side elevational view, in cross-section, of the apparatus shown in FIG. 1 taken along line 2—2 thereof.

In order to assist in developing sufficient propulsion force a paddle element 22 is mounted at the bottom of the apparatus and extends transversely across both pontoons. The paddle element is pivotably supported on a transverse pin or rod 24 such that is may pivot through an arc of substantially 90° from a vertical position as shown in FIG. 2 to a rearward substantially horizontal position. Thus, assuming the right pontoon is moved forwardly, the water pressure will act upon the front face of the paddle element mounted on the right pontoon to cause the element to pivot rearwardly and thereby reduce the frictional or retardant effect of the paddle element in the water. Concomitantly the left pontoon is braced in the water to develop a reaction force against the rear face of its paddle element. The paddle element cannot pivot forwardly beyond the substantially vertical position depicted in FIG. 2 thereby assisting in the development of a forward propulsion force and also facilitating steering of the apparatus.

The apparatus includes transverse stabilizer means which serve to control the lateral drift of the individual pontoons and permit relative longitudinal movement of the pontoons. By providing for the pivotal connection of the pontoon improved step-by-step control is obtained and the structure is made more easily remountable in the event the user is capsized or for any reason desire to remount the apparatus while in the water.

As shown in FIGS. 1 and 2 a pair of elongated members 24, 26 are secured pivotably and slidably to the pontoons by means of a bolt 28 which is anchored in the frame of the pontoon and extends upwardly as shown most clearly in FIG. 2. Each of the elongated members 24, 26 is formed with a pair of spaced slots 30,32. The bolts 28 are dimensioned to fit slidably within the slots so as to permit the pontoons to be movable both longitudinally and laterally relative to each other while remaining interconnected. The bolt may be provided with a nut 34 at its lower threaded portion and with a washer 36 at its upper end to insure retention of the transverse stabilizers on the pontoons. It will be understood, however, that the threaded portion of the bolt 28 may be formed on its upper end if so desired or equivalent fastening means may be employed providing the pivotal sliding interconnection is assured.

On the bottom of each pontoon a longitudinally extending stabilizer keel 38 is fixedly secured. Desirably such stabilizer keel is aligned with the longitudinal center line of each pontoon and is located immediately forward of the paddle element. A preferred construction involves the positioning of the rear edge of the stabilizer keel such that it serves as a limit stop for the forward pivoted movement of the paddle element.

For the purpose of affording assistance to the user of the apparatus in maintaining balance and in the development of propulsion force hand balancing means are provided. In one form such balancing means includes a cable 40 on each pontoon secured at one end to the bow of the pontoon as by an eye bolt 42. The other end of the cable is provided with handle means 44 which may take any conventional form. Desirably the cable is made from a synthetic plastic material such as nylon.

Figure 3:
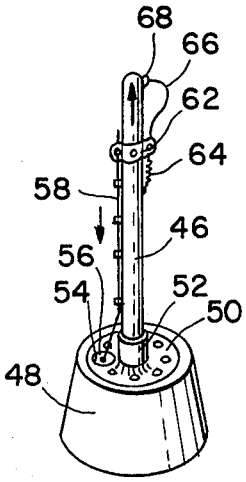
FIG. 3 is a perspective view of a hand balancer in accordance with one embodiment of the invention.
Figure 4:
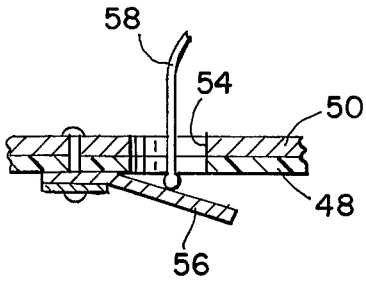
FIG. 4 is an enlarged fragmental cross-sectional view of a portion of the plate and valve plate employed in the hand balancer of FIG. 3.

Another form of hand balancer is shown in FIGS. 3 and 4. As shown particularly in FIG. 3 the hand balancer includes an elongated pole element 46 and an inverted bucket 48 which is open at its lower end and closed at its upper end by means of a closure plate 50. The pole element is secured at its lower end to the closure plate and a convenient manner of providing for such securement includes the welding of a tubular flange 52 to the center of the closure plate and the crimping of the flange onto the lower end of the pole element. However, other constructional arrangments may be resorted to which will assure the rigid connection required between the pole element and closure plate.

The closure plate is given an aperture 54 which extends completely therethrough as shown in FIG. 4, and a rubber flapper valve 56 is pivotably secured to the closure plate such that it can be moved so as to selectively open or close the aperture to the flow of air therethrough from the lower open end of the bucket. In this manner the vacuum formed by removing the bucket from the water may be released as desired by the user etc.

A push rod element 58 is connected at one end thereof to the valve plate. The other end of the cable element terminates in a connection with one arm of a bell crank 62. A short length of cable 66 which has a handle element 68 at one thereof is connected to the other arm of the bell crank. The intermediate section of the push rod element 58 is preferably disposed within a longitudinally extending groove or recess (not shown) formed in the pole element. Bell crank 62 is secured pivotably to the pole element. One arm of the bell crank is spring-biased as by a coil return spring 64 whereas the other arm of the bell crank, as described above, has secured thereto the upwardly extending push rod element 58. As desired the connections between the bell crank, spring, cable element and rubber flapper valve may be arranged to maintain the rubber flapper valve in either a normally open or normally closed position.

From the foregoing description of the invention it will seen that improved water-walking apparatus has been provided which affords permanent interconnection between the pontoons and yet enables the pontoons to be moved longitudinally and laterally of each other as is required in developing the forward propulsion force. Thus, lateral control is provided without sacrificing any development of the forward propulsion force. Also, the overall stability of the apparatus has been enhanced through the capability of limited lateral movement of the pontoons.

I claim:

1. Apparatus for walking on water comprising in combination:

a pair of elongated buoyant pontoons;

a boot in each of said pontoons for receiving and supporting the foot of a person;

a paddle element mounted at the bottom and extending transversely of said pontoons, said paddle element being pivotable by water pressure between a substantially vertical position and a rearward substantially horizontal position;

transverse stabilizer means including a pair of elongated members secured to the upper surface of each of said pontoons, each of said elongated members having a pair of longitudinally spaced slots, bolt means being secured to each of said pontoons and extending upwardly through the respective slots to pivotally and slidably connect each of said elongated members to said pontoons whereby said pontoons are interconnected so as to be movable longitudinally and laterally relative to each other;

and balancing means for the user of the apparatus.

2. Apparatus according to claim 1, including a longitudinally extending stabilizer keel secured fixedly to the bottom of each of said pontoons substantially coincident with the longitudinal center lines thereof.

3. Apparatus according to claim 1, wherein said balancing means includes a cable for each of said pontoons secured at one end threof to the front of the pontoon and at the other thereof provided with handle means.

4. Apparatus according to claim 1, wherein said balancing means includes a pair of pole and bucket assemblies, each of said assemblies comprising an elongated pole element, an inverted bucket open at the lower end thereof and closed at the upper end by a closure plate, said pole being fixedly secured to said bucket at its closed end, an aperture in said plate element, a rubber flapper valve pivotably mounted on said closure plate to selectively open and close said aperture, and hand operable valve control means carried by said pole element operably connected to said valve plate.

5. Apparatus according to claim 4, including a cable connected at one thereof to said rubber flapper valve, a bell crank mounted pivotably on the upper portion of said pole element, said cable being connected adjacent the other end thereof to one arm of said bell crank, and the other arm of said bell crank being spring-biased to thereby maintain the rubber flapper valve in the desired position, an additional cable element being connected between said one arm of said bell crank and handle means to selectively actuate said rubber flapper valve against the spring-bias.

* * * * *